US010352635B2

(12) United States Patent
Noonan

(10) Patent No.: US 10,352,635 B2
(45) Date of Patent: Jul. 16, 2019

(54) FIREARM WITH FORWARD CHARGING SYSTEM

(71) Applicant: F.M. Products Inc, Boise, ID (US)

(72) Inventor: Paul T. Noonan, Boise, ID (US)

(73) Assignee: F.M. Products Inc, Boise, ID (US)

( * ) Notice: Subject to any disclaimer, the term of this patent is extended or adjusted under 35 U.S.C. 154(b) by 0 days.

(21) Appl. No.: 15/863,856

(22) Filed: Jan. 5, 2018

(65) Prior Publication Data

US 2018/0195820 A1 Jul. 12, 2018

Related U.S. Application Data

(60) Provisional application No. 62/443,173, filed on Jan. 6, 2017.

(51) Int. Cl.

| | |
|---|---|
| ***F41A 3/72*** | (2006.01) |
| ***F41C 23/16*** | (2006.01) |
| ***F41A 3/66*** | (2006.01) |
| ***F41G 11/00*** | (2006.01) |
| ***F41A 5/18*** | (2006.01) |
| ***F41A 5/30*** | (2006.01) |

(52) U.S. Cl.

CPC *F41A 3/72* (2013.01); *F41A 3/66* (2013.01); *F41A 5/18* (2013.01); *F41A 5/30* (2013.01); *F41C 23/16* (2013.01); *F41G 11/003* (2013.01)

(58) Field of Classification Search

CPC ..... F41A 3/72; F41A 7/02; F41A 35/06

See application file for complete search history.

(56) References Cited

U.S. PATENT DOCUMENTS

| | | | | |
|---|---|---|---|---|
| 7,231,861 | B1 * | 6/2007 | Gauny | F41A 3/72 42/16 |
| 8,266,998 | B1 * | 9/2012 | Davis | F41A 35/06 42/71.01 |
| 8,567,301 | B1 * | 10/2013 | Sharron | F41A 35/06 89/1.4 |
| 8,863,632 | B1 * | 10/2014 | O'Malley | F41A 3/72 42/16 |
| 9,354,014 | B2 * | 5/2016 | Swadener | F41A 3/72 |
| 2011/0036232 | A1 * | 2/2011 | Dublin | F41A 3/72 89/1.4 |
| 2011/0271827 | A1 * | 11/2011 | Larson | F41A 5/28 89/193 |
| 2012/0180647 | A1 * | 7/2012 | Dublin | F41A 3/72 89/191.01 |
| 2015/0226501 | A1 * | 8/2015 | Gibbens | F41A 3/66 42/16 |
| 2016/0047614 | A1 * | 2/2016 | Larson, Jr. | F41G 11/003 89/191.01 |
| 2018/0202732 | A1 * | 7/2018 | Gibbens | F41A 3/72 |

FOREIGN PATENT DOCUMENTS

| | | | | |
|---|---|---|---|---|
| EP | 2141436 | A2 * | 1/2010 | F41A 3/72 |

* cited by examiner

*Primary Examiner* — Benjamin P Lee

(57) ABSTRACT

A forward charging system is disclosed. The forward charging system contains a charging trolley containing one or more channels configured to accommodate one or more rails associated with a hand guard, wherein the charging trolley is movable along the one or more rails between a rest position and a charging position, and a rod coupled to a rear portion of the charging trolley, the rod is configured to move a bolt carrier assembly away from a locked position when the charging trolley is moved away from the rest position.

10 Claims, 21 Drawing Sheets

FIREARM WITH FORWARD CHARGING SYSTEM

CROSS REFERENCE TO RELATED APPLICATIONS

This application claims the benefit of U.S. Provisional Application No. 62/443,173, filed on Jan. 6, 2017, which is incorporated herein by reference in its entirety.

FIELD

The present invention relates to a firearm. More particularly, the present invention relates to a firearm with forward charging system.

BACKGROUND

Referring to FIG. 1, top-mounted T-shaped charging handle 2 is standard feature of M-16 and Armalite style rifles (ARs). When the charging handle 2 is pulled back towards the butstock, the operator of the firearm can eject a spent shell casing or an unfired cartridge from a chamber, load a round from the magazine, clear a jam or misfire, move a bolt into battery, and/or release a bolt locked to the rear. However, to accomplish any of these tasks, the operator of the firearm must tilt the firearm towards the ground and away from the intended target to get the leverage necessary to operate the charging handle 2.

There needs to be a better way of performing these tasks without forcing the operator of the firearm to move the firearm away from the intended target.

In the following description, like reference numbers are used to identify like elements. Furthermore, the drawings are intended to illustrate major features of exemplary embodiments in a diagrammatic manner. The drawings are not intended to depict every feature of every implementation nor relative dimensions of the depicted elements, and are not drawn to scale.

DETAILED DESCRIPTION

In the following description, numerous specific details are set forth to clearly describe various specific embodiments disclosed herein. One skilled in the art, however, will understand that the presently claimed invention may be practiced without all of the specific details discussed below. In other instances, well known features have not been described so as not to obscure the invention.

Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Figure 2A:
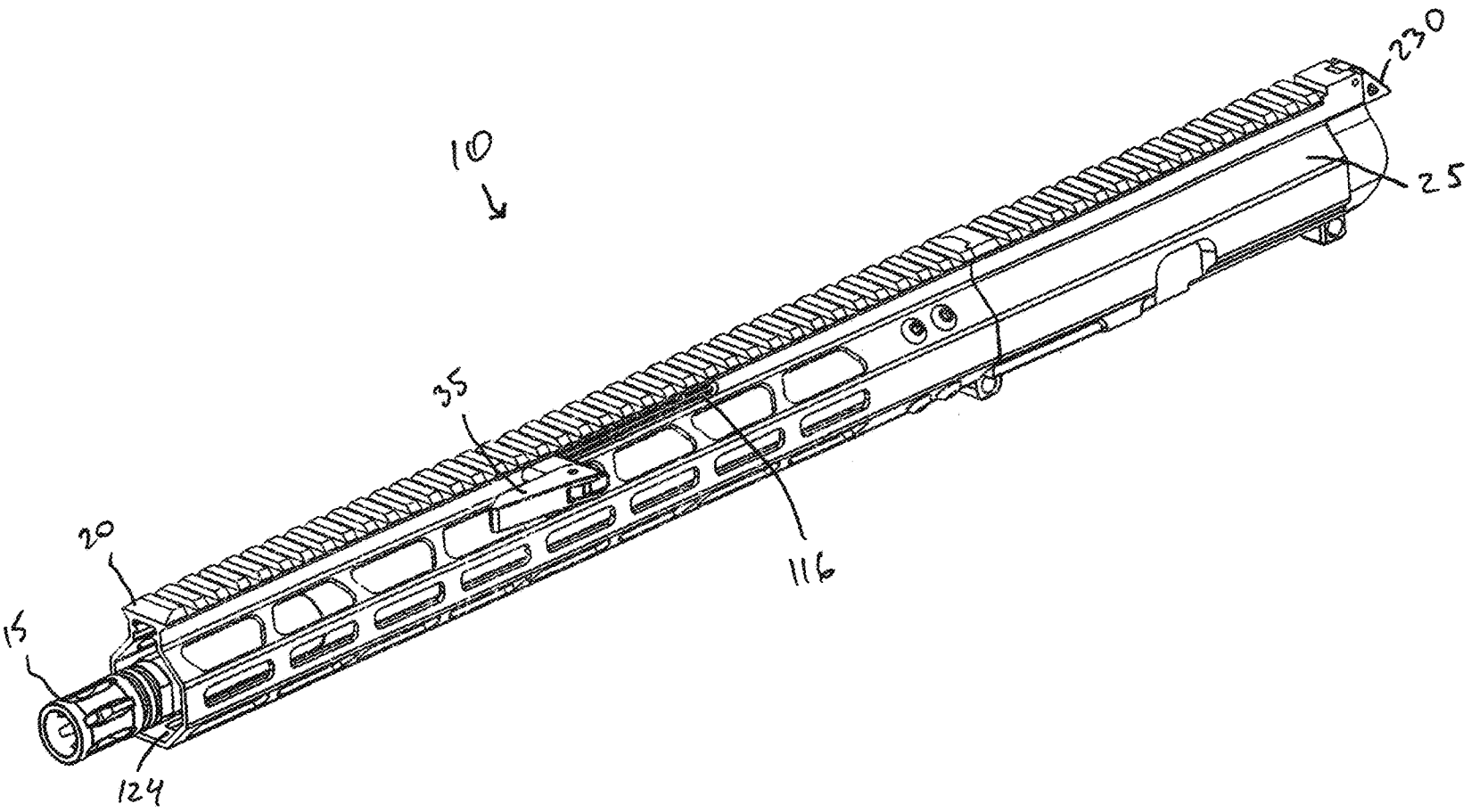
FIG. 2*a* depicts an assembled view of an upper receiver assembly according to the present disclosure.
Figure 2B:
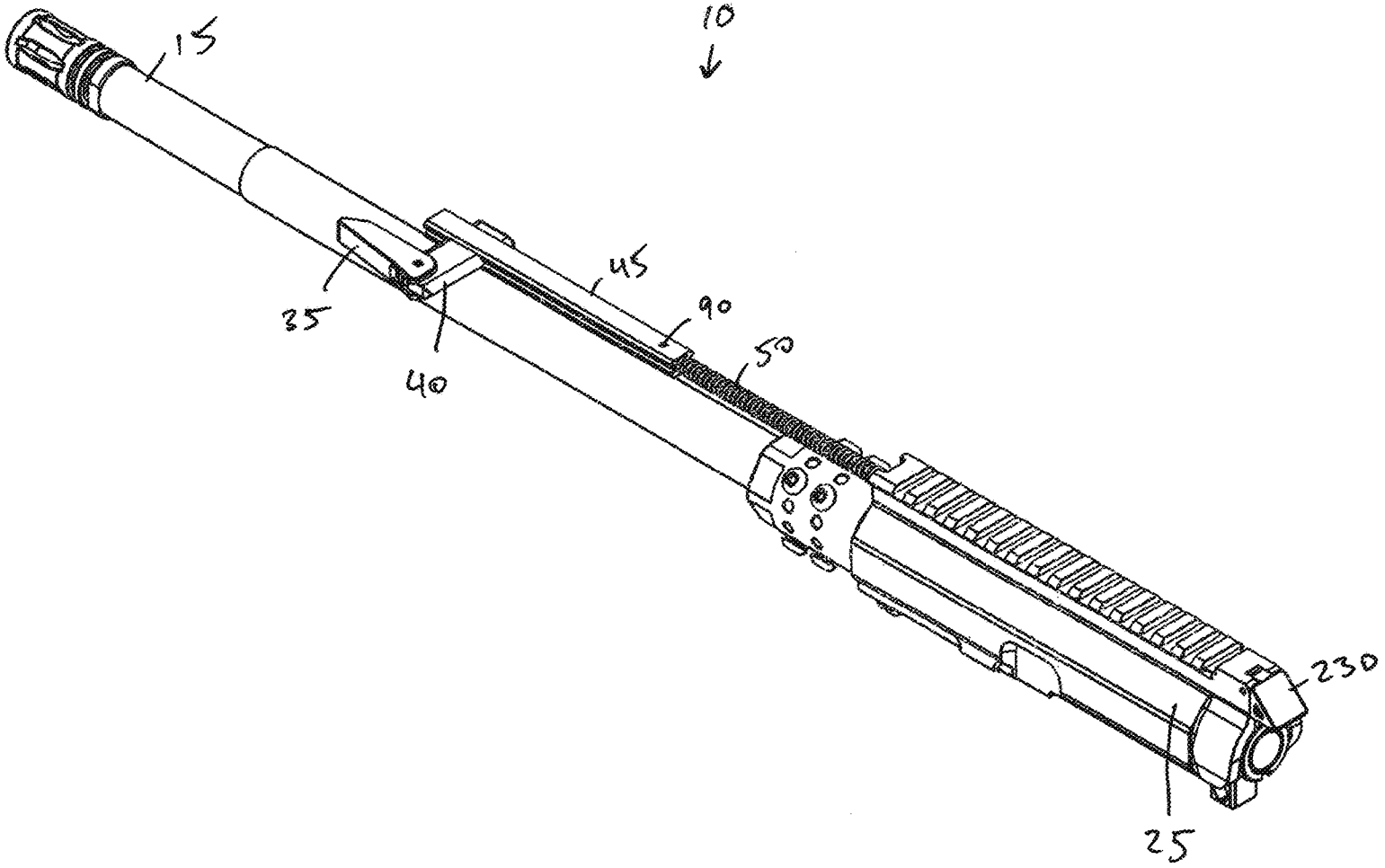
FIG. 2*b* depicts a partially disassembled view of the upper receiver assembly shown in FIG. 2*a*.
Figure 8:
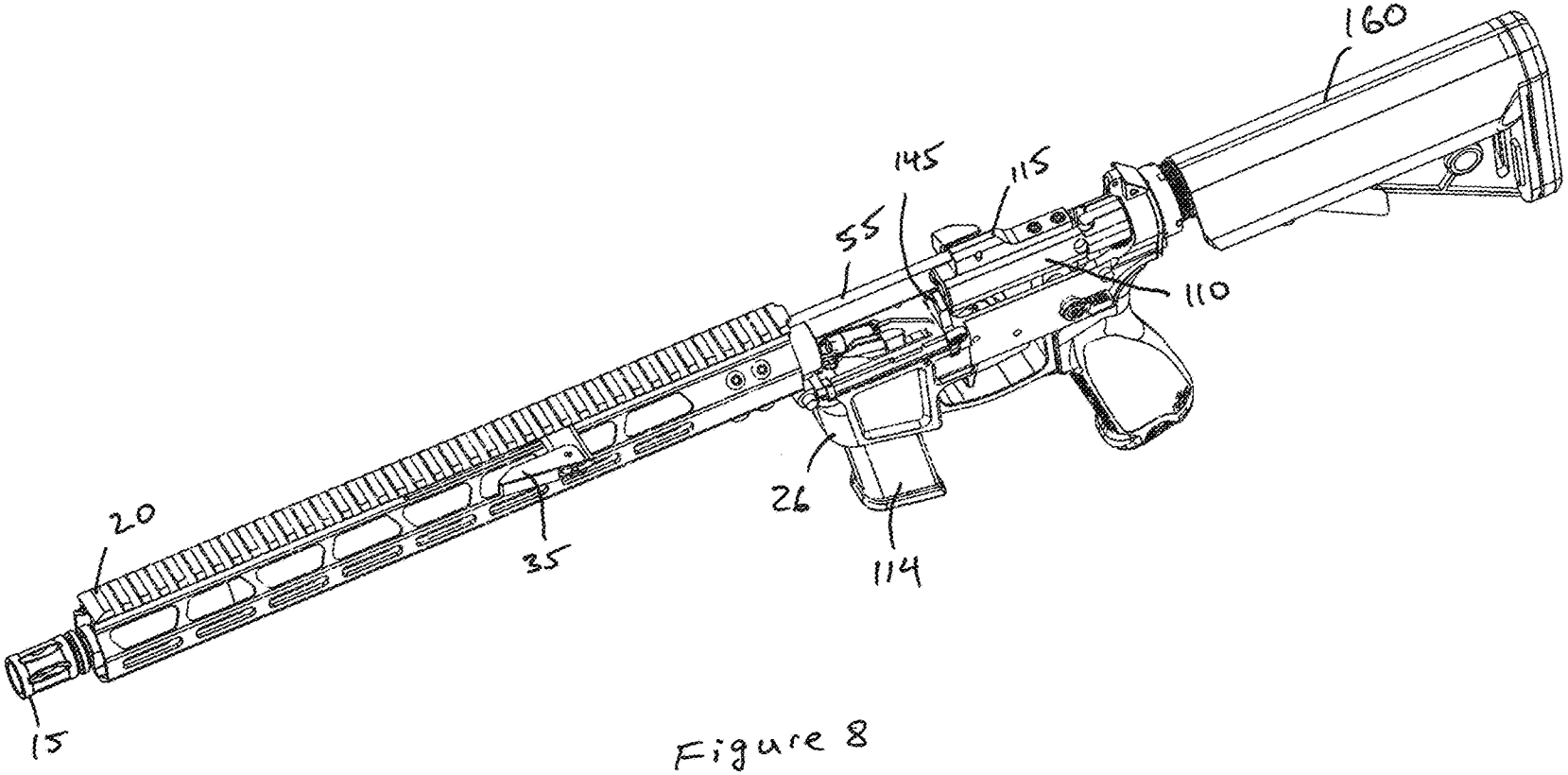
FIGS. 8-10 depict forward charging system according to the present disclosure.
Figure 9:
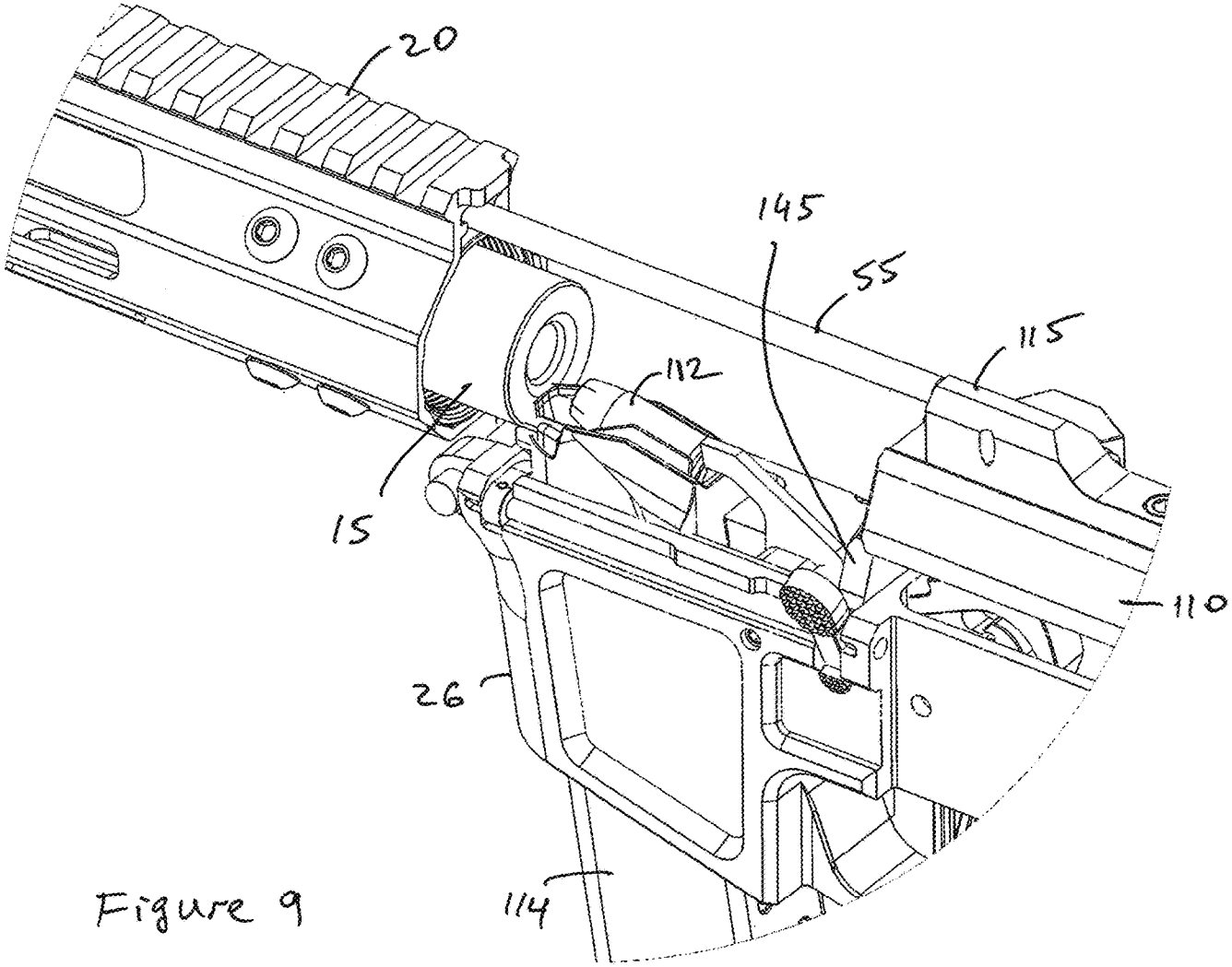
Figure 10:
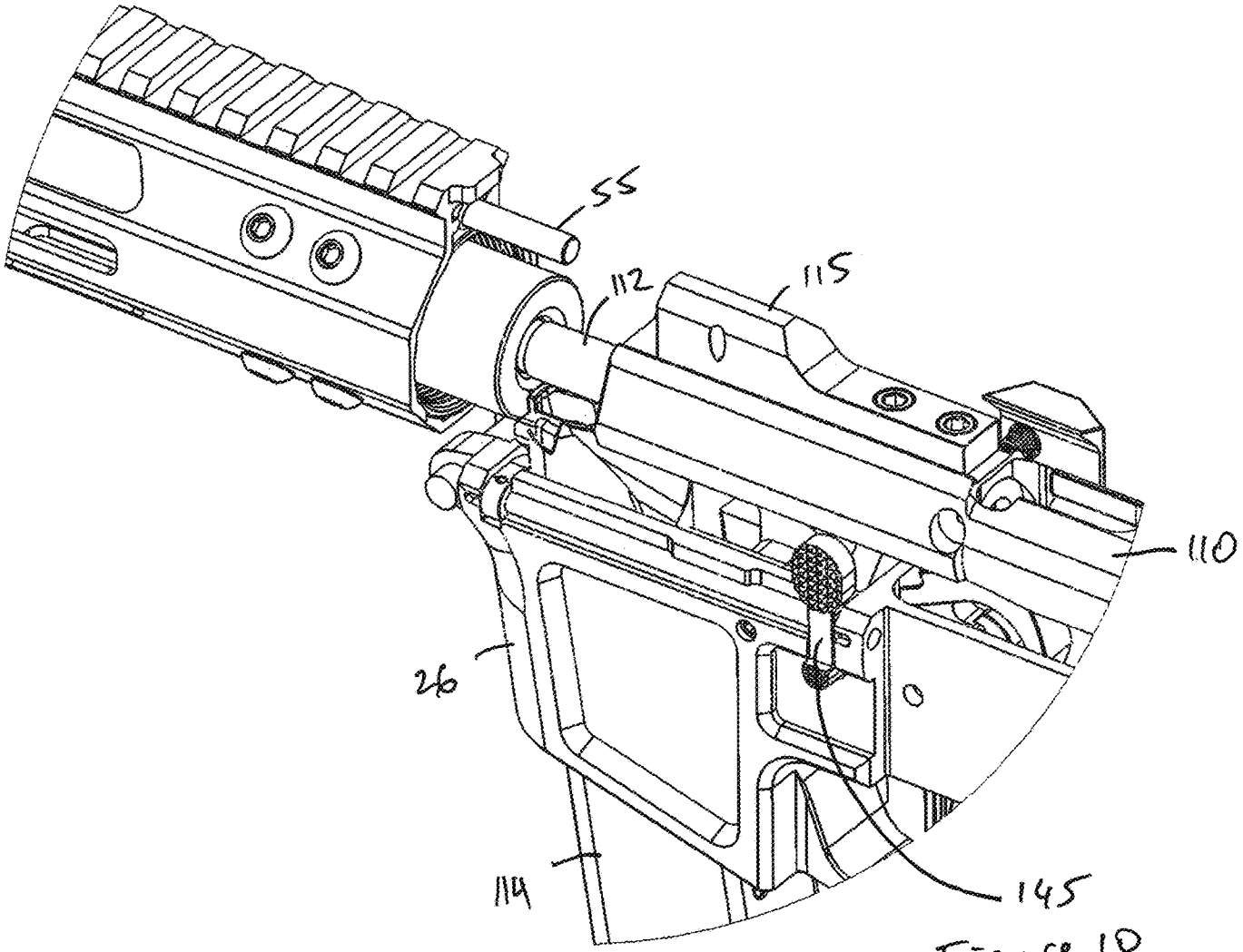

Referring to FIG. 2*a*, an upper receiver assembly 10 is shown according to some embodiments presently disclosed. The upper receiver assembly 10 comprises a barrel 15, a hand guard 20 and an upper receiver 25. According to some embodiments the upper receiver 25 is coupled to a lower receiver 26 shown in FIGS. 8-10. The hand guard 20 may removably encircle the barrel 15. According to some embodiments the upper receiver 25 is coupled with the barrel 15 as shown in FIG. 2*b*. According to some embodiments the upper receiver 25 is coupled with the hand guard 20. According to some embodiments the hand guard 20 is coupled with the barrel 15 as shown in FIGS. 9-10.

Referring to FIGS. 2*b*-4, the upper receiver assembly 10 comprises a forward charging system 30 according to some embodiments presently disclosed. The forward charging system 30 comprises a charging base 40, a charging trolley 45, and a rod 55. The forward charging system 30 may also comprise a return spring 50.

The charging trolley 45 comprises a forward portion 60 and a rear portion 65. According to some embodiments presently disclosed, the charging base 40 is coupled with the charging trolley 45's forward portion 60. According to some embodiments presently disclosed, the charging base 40 is coupled with the charging trolley 45 adjacent to the forward portion 60. According to some embodiments presently disclosed, the charging trolley 45 comprises an opening 75 (shown in FIG. 4) configured to accommodate the charging base 40 as shown in FIG. 5. The opening 75 may be a through opening to allow the charging base 40 to be inserted on either the right or left side of the charging trolley 45. The charging base 40 may be coupled with the charging trolley 45 using, for example, a fastener 70 shown in FIGS. 6-7. The fastener 70 may be a pin, a screw, a set screw, a full dog point set screw, or a dogleg set screw. According to some embodiments presently disclosed, the charging trolley 45 comprises an opening 80 (shown in FIGS. 5-7) and the charging base 40 comprises an opening 85 (shown in FIG. 4). The openings 80 and 85 are configured to accommodate the fastener 70. A set screw may be fully threaded and does not have any head projecting out of the screw thread. According to some embodiments presently disclosed, the charging base 40 is coupled substantially perpendicular to the charging trolley 45. According to some embodiments presently disclosed, the charging base 40 is coupled at an angle to the charging trolley 45.

The rod 55 comprises a forward portion 56 and a rear portion 58. According to some embodiments presently disclosed, rod 55's forward portion 56 is coupled with the charging trolley 45's rear portion 65. The rod 55 may be coupled with the charging trolley 45 using, for example, a fastener 90 shown in FIG. 4. The fastener 90 may be a pin, a screw, a set screw, a full dog point set screw, or a dogleg set screw. According to some embodiments presently disclosed, the charging trolley 45 comprises an opening 95 configured to accommodate rod 55's forward portion 56. According to some embodiments presently disclosed, the charging trolley 45 comprises an opening 100 and the rod 55 comprises an opening 105. The openings 100 and 105 are configured to accommodate the fastener 90.

According to some embodiments presently disclosed, the upper receiver 25 comprises a bolt carrier assembly 110. The bolt carrier assembly 110 is movable between a first (locked) position and a second (unlocked) position. The bolt carrier assembly 110 supports and positions a bolt (not shown). The first (locked) position is position in which the bolt carrier 110 has positioned the bolt (not shown) for firing ammunition through the barrel 15. The second (unlocked) position is any position other than the first (locked) position as shown in FIGS. 8-10.

According to some embodiments presently disclosed, the upper receiver 25 comprises a carrier key 115 coupled with a top portion of the bolt carrier assembly 110. One or more fasteners 120 may be used to couple the carrier key 115 with the bolt carrier assembly 110. The one or more fasteners 120 may be a pin, a screw, a set screw, a full dog point set screw, or a dogleg set screw.

According to some embodiments presently disclosed, the forward charging system 30 is configured to move the bolt carrier assembly 110 from the first (locked) position to the second (unlocked).

Figure 1:
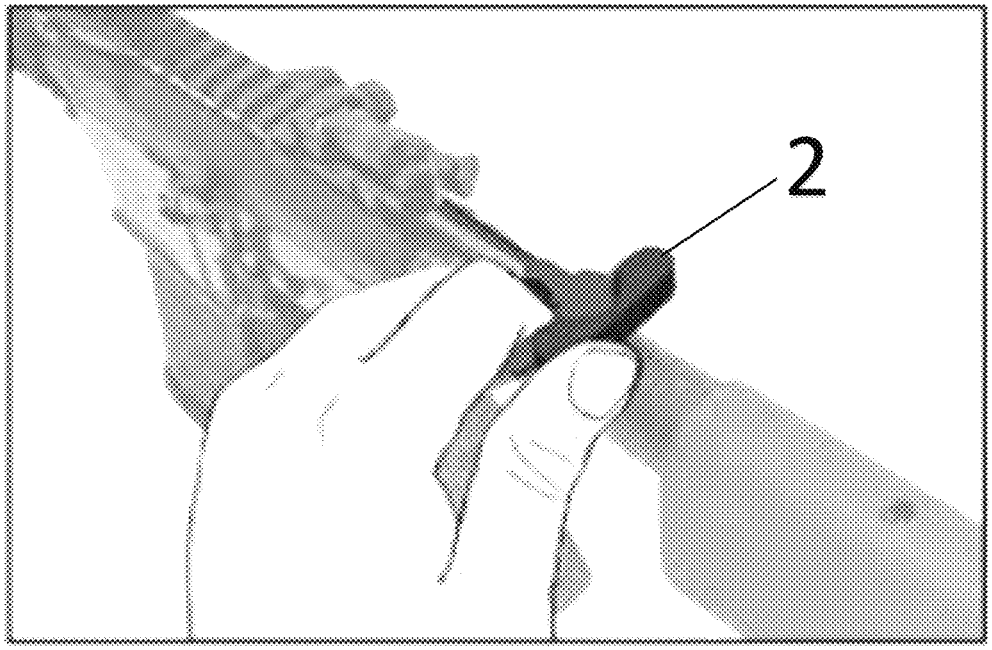
Figure 1 PRIOR ART
FIG. 1 depicts a top-mounted T-shaped charging handle as known in the prior art.
Figure 3:
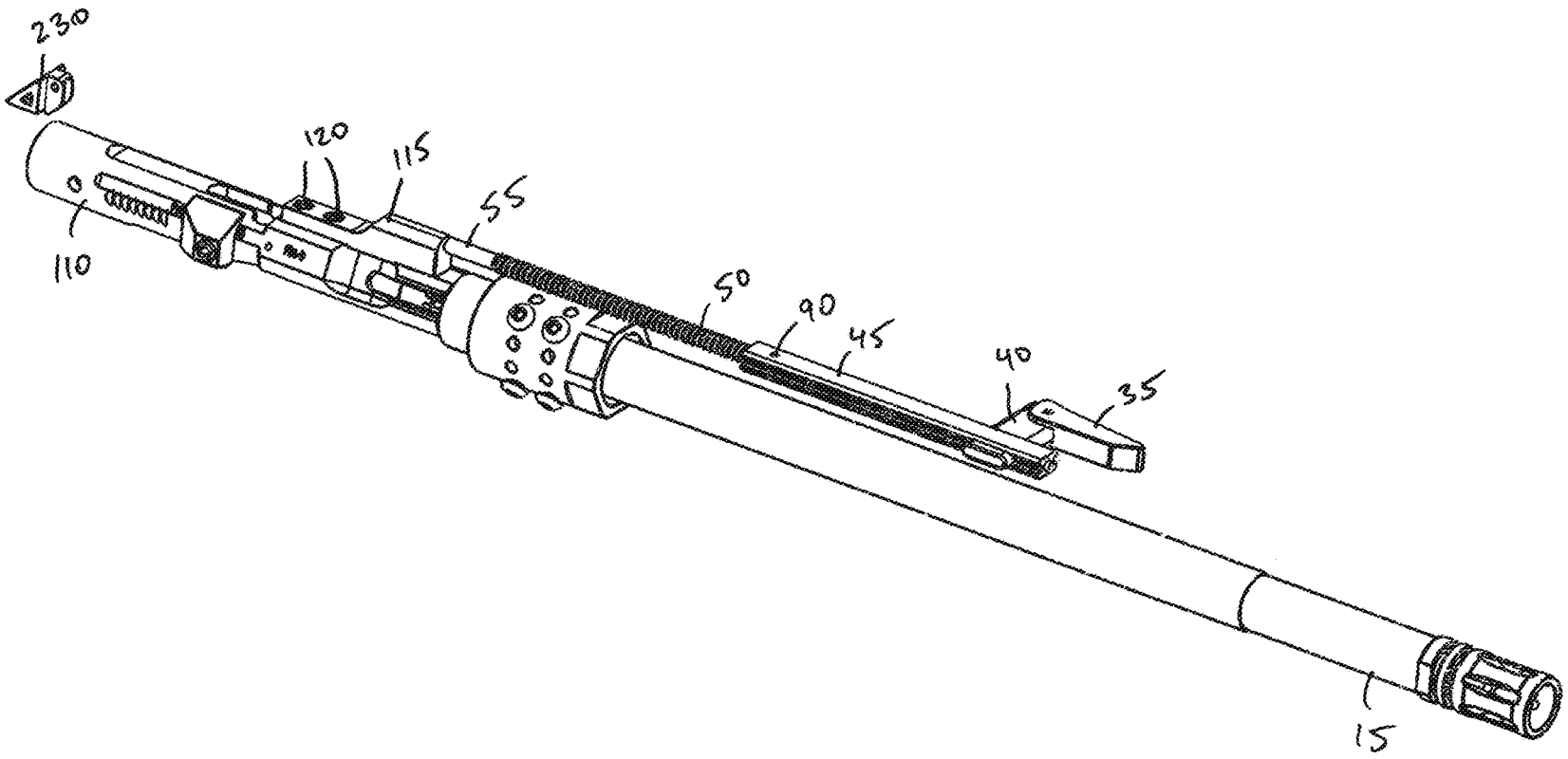
FIG. 3 depicts another partially disassembled view of the upper receiver assembly shown in FIG. 2*a*.
Figure 11:
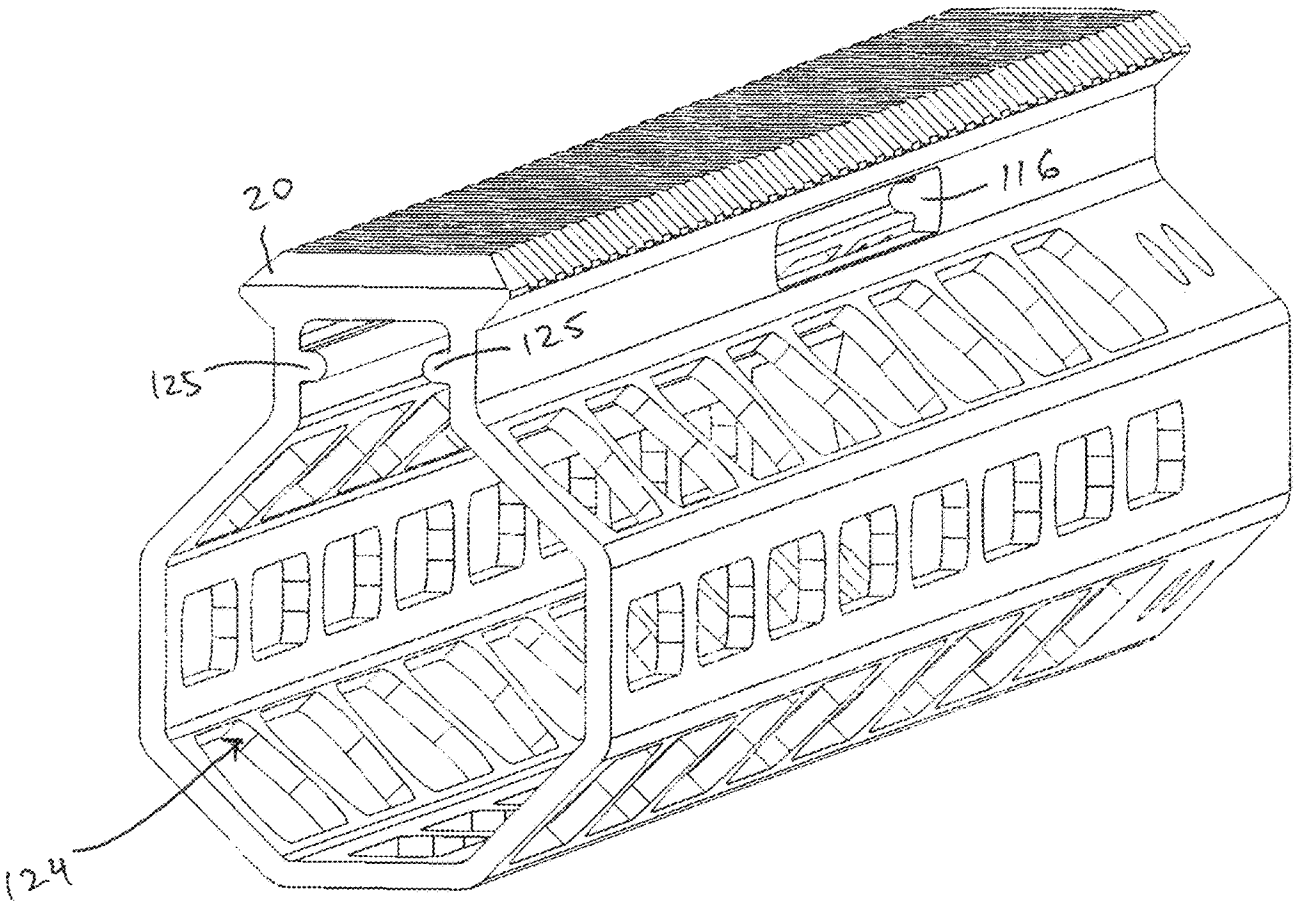
FIGS. 11-12 depict a hand guard according to the present disclosure.

According to some embodiments presently disclosed, the charging base 40 is positioned to protrude though an opening 116 of the hand guard 20 (as shown in FIGS. 1 and 11). According to some embodiments presently disclosed, the charging base 40 is positioned adjacent to the barrel 15 as shown in FIGS. 2-3. According to some embodiments presently disclosed, the charging base 40 is positioned away from the upper receiver 25 as shown in FIGS. 2-3. According to some embodiments presently disclosed, the charging base 40 is positioned away from the upper receiver 25 and towards the front of the firearm and as shown in FIGS. 2-3.

According to some embodiments presently disclosed, the hand guard 20 comprises an opening 124 configured to accommodate the barrel 15 (shown in FIGS. 2*a* and 11). According to some embodiments presently disclosed, the hand guard 20 comprises one or more rails 125 extending into the opening 124. According to some embodiments presently disclosed, the one or more rails 125 are formed during manufacturing of the hand guard 20. According to some embodiments presently disclosed, the one or more rails 125 are extruded during manufacturing of the hand guard 20. According to some embodiments presently disclosed, the one or more rails 125 run along the entire length of the hand guard 20. According to some embodiments presently disclosed, the one or more rails 125 run along a portion of the hand guard 20.

Figure 12:
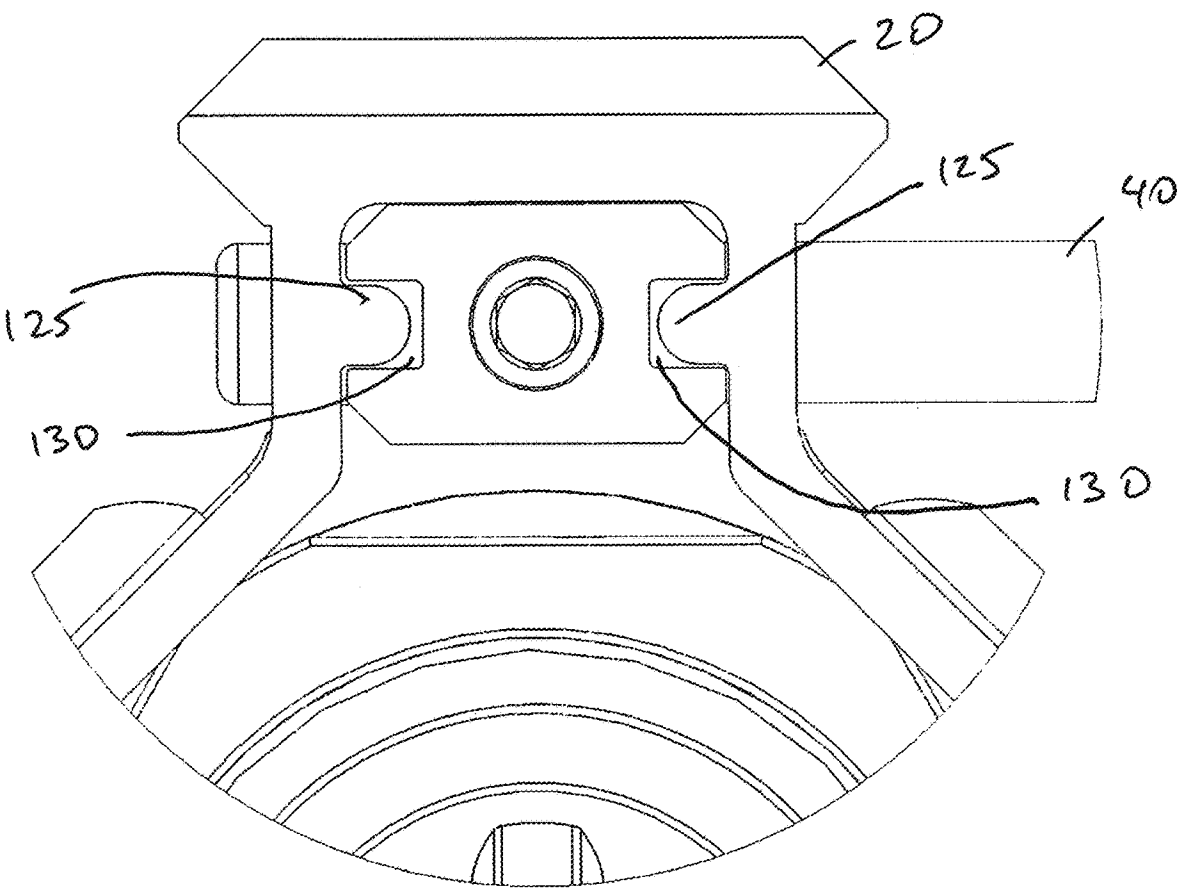

According to some embodiments presently disclosed, the charging trolley 45 comprises one or more channels 130 (shown in FIGS. 5 and 12) configured to accommodate the one or more rails 125 as shown in FIG. 12. According to some embodiments presently disclosed, the one or more channels 130 run along the entire length of the charging trolley 45 as shown in FIG. 5. The charging trolley 45 is configured to slide along the one or more rails 125 from a first (rest) position to a second (charging) position and back to the first (rest) position.

According to some embodiments presently disclosed, moving the charging trolley 45 towards the second (charging) position causes rod 55's rear portion 58 to abut (i.e. engage) the carrier key 115. According to some embodiments presently disclosed, moving the charging trolley 45 towards the second (charging) position causes rod 55's rear portion 58 to engage the carrier key 115 and move the bolt carrier assembly 110 from the first (locked) position to the second (unlocked) position. According to some embodiments presently disclosed, moving the charging trolley 45 towards the second (charging) position causes rod 55's rear portion 58 to move the bolt carrier assembly 110 from the first (locked) position to the second (unlocked) position. According to some embodiments presently disclosed, moving the charging trolley 45 towards the second (charging) position causes rod 55's rear portion 58 to engage the carrier key 115 and move the bolt carrier assembly 110 away from the barrel 15.

According to some embodiments presently disclosed, the charging trolley 45's second (charging) position is position in which the charging trolley 45 is positioned closer to the upper receiver 25. According to some embodiments presently disclosed, the charging trolley 45's first (rest) position is position in which the charging trolley 45 is positioned closer to the front of the firearm and away from the upper receiver 25. According to some embodiments presently disclosed, the charging trolley 45's second (charging) position is position in which the rod 55 moves the bolt carrier assembly 110 to the second (unlocked) position. According to some embodiments presently disclosed, the charging trolley 45's first (rest) position is position in which the rod 55 allows the bolt carrier assembly 110 to return to the first (locked) position. According to some embodiments presently disclosed, the charging trolley 45's first (rest) position is position in which the rod 55 is positioned away from the carrier key 115.

According to some embodiments presently disclosed, the lower receiver 26 comprises a bolt hold open 145 shown in FIG. 8. The bolt hold open 145 is configured to move from a first (open) position to a second (blocking) position. According to some embodiments presently disclosed, at least a portion of the bolt hold open 145 moves vertically from the first (open) position to the second (blocking) position. When the bolt hold open 145 is in the first (open) position (as shown in FIG. 10), the bolt carrier assembly 110 is able to freely move between the first (locking) position and the second (unlocked) position. When the bolt hold open 145 is in the second (blocking) position (as shown in FIG. 8), the bolt carrier assembly 110 is prevented from moving forward to the first (locking) position.

According to some embodiments presently disclosed, moving the charging trolley 45 towards the second (charging) position causes rod 55's rear portion 58 to engage the carrier key 115 and move the bolt carrier assembly 110 away from the bolt hold open 145 thereby allowing the bolt hold open 145 to move to the first (open) position. Allowing the bolt hold open 145 to move to the first (open) position allows the bolt carrier assembly 110 to move towards the first (locked) position when the charging trolley 45 is moved towards the first (rest) position.

According to some embodiments presently disclosed, rod 55's rear portion 58 is a first distance from the carrier key 115 when the charging trolley 45 is in the first (rest) position and the bolt carrier assembly 110 is in the first (locked) position. According to some embodiments presently disclosed, the first distance is about 0.05 inches. According to some embodiments presently disclosed, rod 55's rear portion 58 is spaced away from the carrier key 115 when the charging trolley 45 is in the first (rest) position and the bolt carrier assembly 110 is in the first (locked) position.

According to some embodiments presently disclosed, the charging trolley 45 is moved towards the second (charging) position by applying a first force on the charging base 40 towards the second (charging) position. According to some embodiments presently disclosed, the charging trolley 45 is moved towards the second (charging) position by applying a first force on the charging base 40 towards a butstock 160 located at the rear of the firearm (shown in FIG. 8).

According to some embodiments presently disclosed, the upper receiver 25 comprises a through opening 150 to allow the rod 55 to pass though and be able to engage the carrier key 115.

Figure 13:
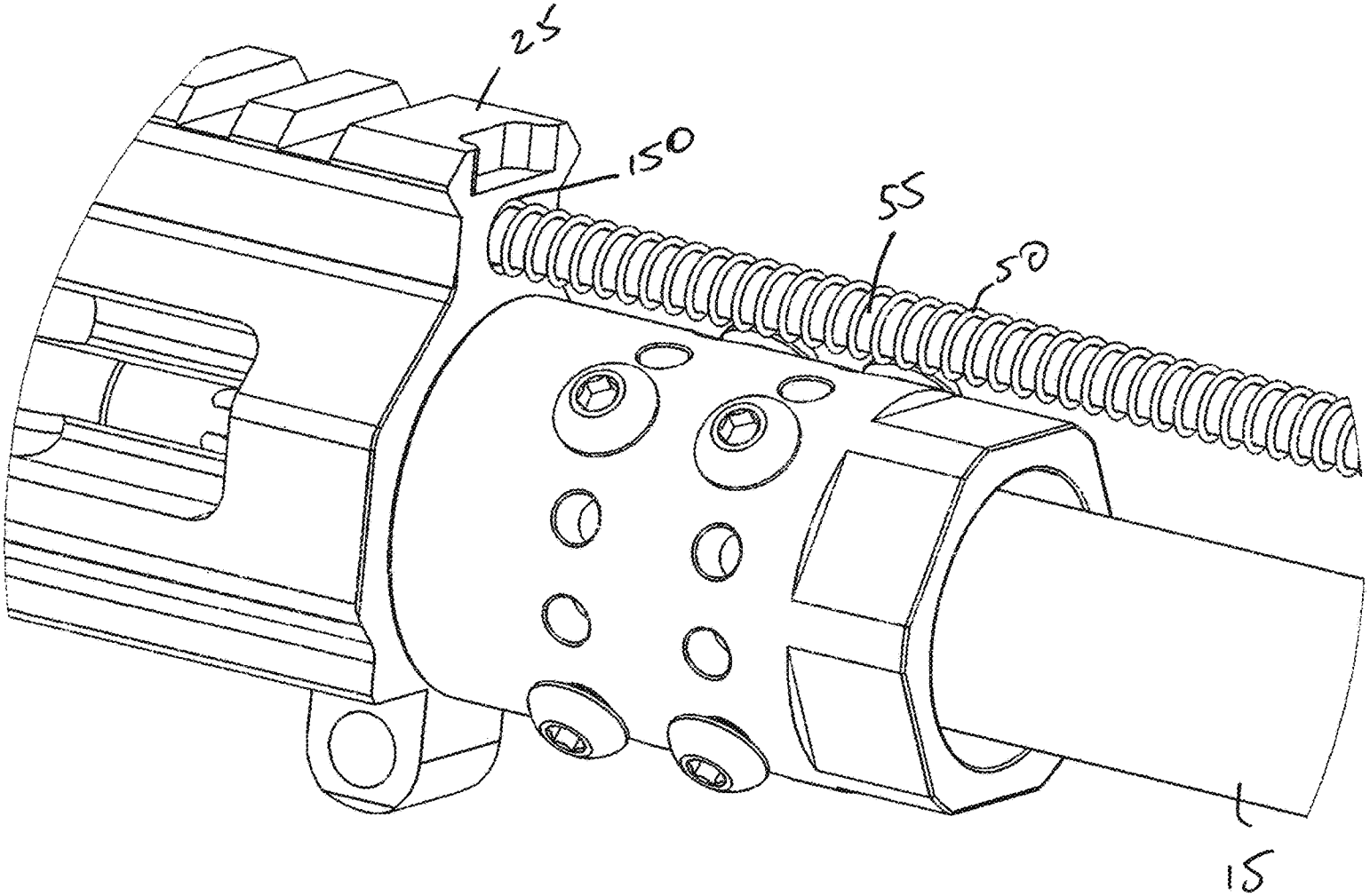
FIG. 13 depicts forward charging system according to the present disclosure.

According to some embodiments presently disclosed, the rod 55 passes through the return spring 50 that is positioned between the upper receiver 25 and the charging trolley 45 as shown in FIGS. 2*b* and 13. According to some embodiments presently disclosed, moving the charging trolley 45 towards the second (charging) position compresses the return spring 50 between the charging trolley 45 and the upper receiver 25. According to some embodiments presently disclosed, applying the first force to the charging base 40 compresses the return spring 50 between the charging trolley 45 and the upper receiver 25. Removing the first force causes the compressed return spring 50 to return the charging trolley 45 back to the first (rest) position. According to some embodiments presently disclosed, the return spring 50 prevents the charging trolley 45 from moving from the first (rest) position towards the second (charging position). According to some embodiments presently disclosed, the return spring 50 prevents the charging trolley 45 from moving from the first (rest) position towards the second (charging position) during normal operations of the firearm.

Although the charging base 40 can be used to move the charging trolley 45 from the first (rest) position towards the second (charging) position, the forward charging system 30 may further comprise a charging handle 35 coupled with the charging base 40. The charging handle 35 may be pivotally coupled with the charging base 40. According to some embodiments presently disclosed, the charging trolley 45 is moved towards the second (charging) position by applying a second force on the charging handle 35 towards the second (charging) position. According to some embodiments presently disclosed, the charging trolley 45 is moved towards the second (charging) position by applying a second force on the charging handle 35 towards the butstock 160 located at the rear of the firearm (shown in FIG. 8).

According to some embodiments presently disclosed, the charging handle 35 comprises a channel (i.e. an opening) 180 configured to accommodate at least a portion of the charging base 40 (as shown in FIG. 5). According to some embodiments presently disclosed, the charging handle 35 comprises a U-shaped channel 180 comprising a first sidewall 182, a second sidewall 184 and a top wall 186 connecting the sidewalls 182 and 184. The U-shaped channel 180 is configured to accommodate at least a portion of the charging base 40 (as shown in FIG. 5).

Figure 4:
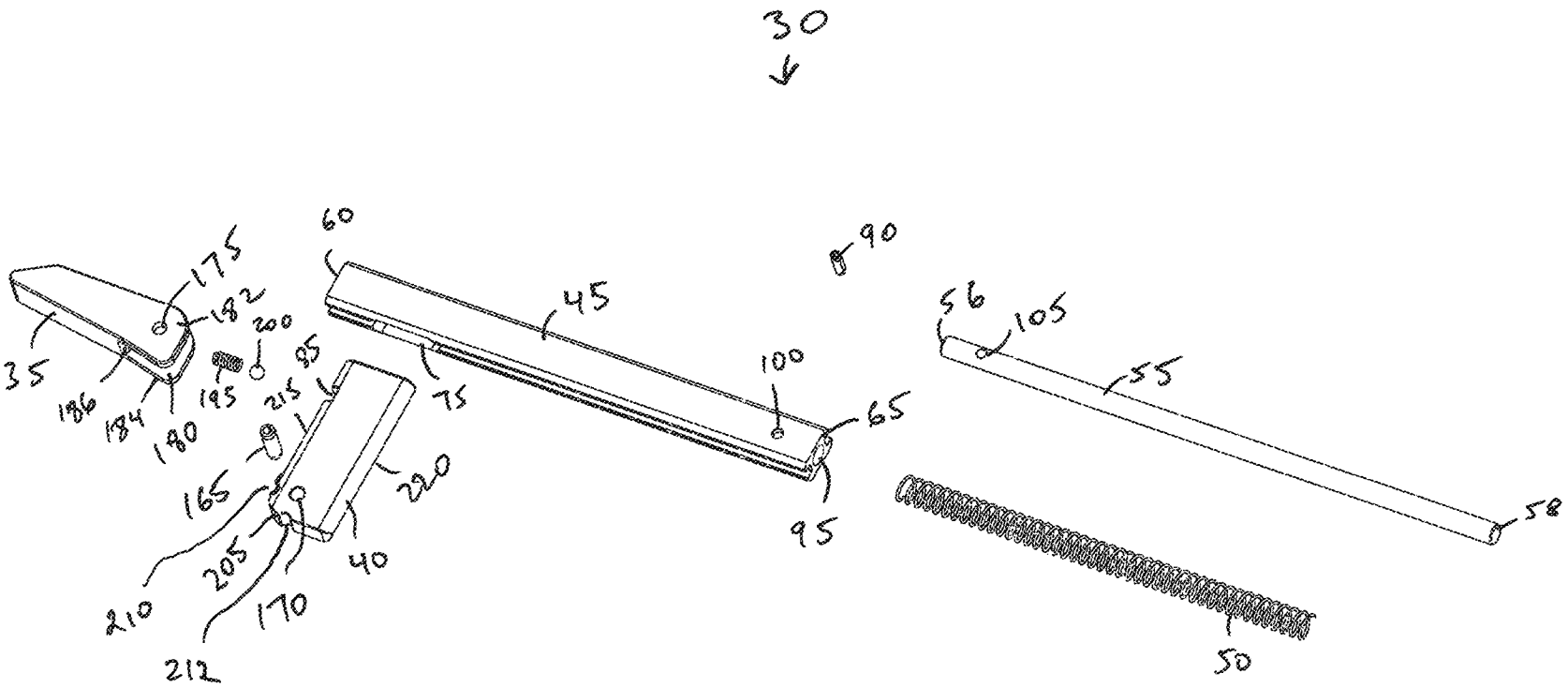
FIG. 4 depicts a forward charging system according to the present disclosure.
Figure 5:
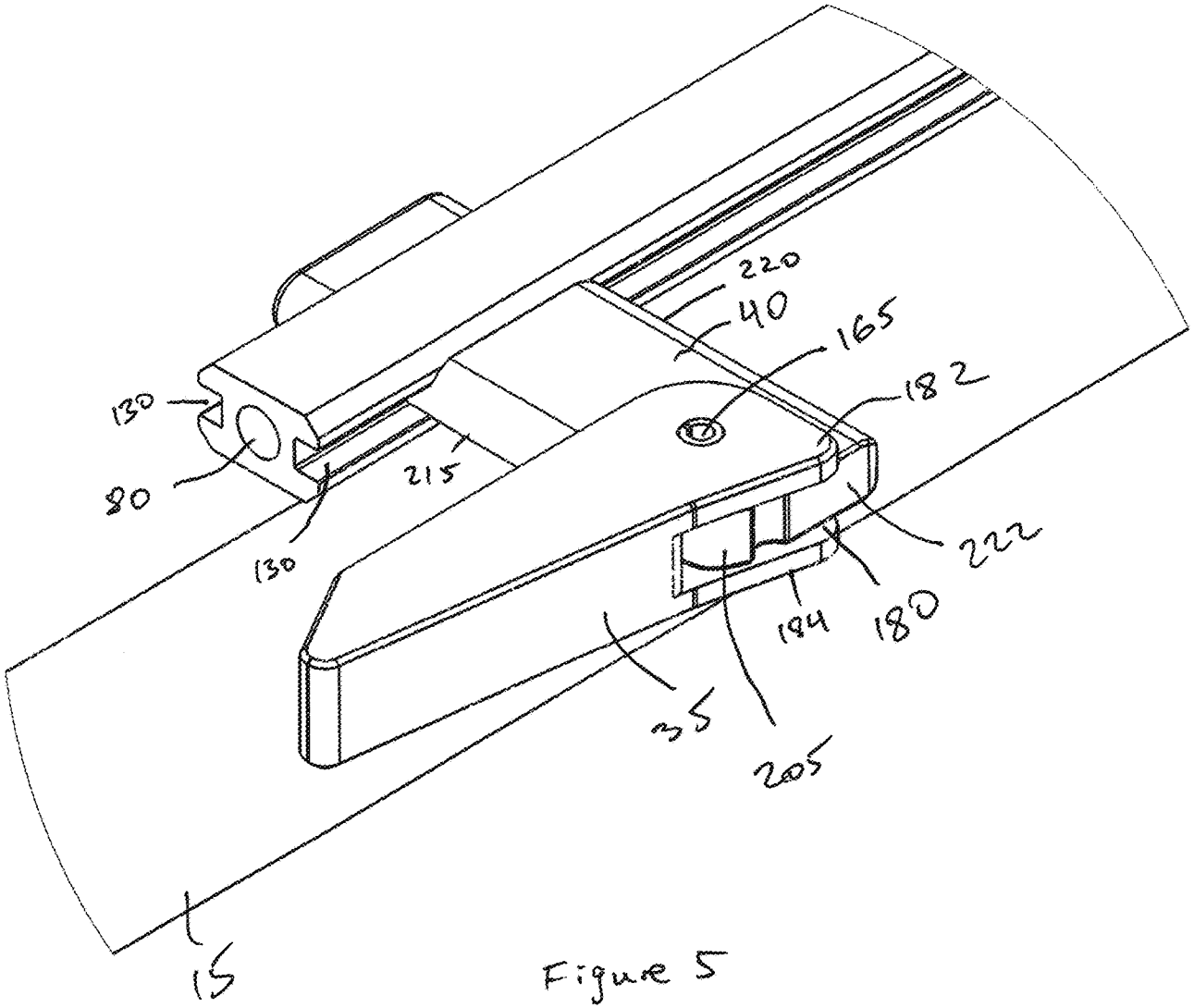
FIGS. 5-7 depict a close up view of the forward charging system according to the present disclosure.

According to some embodiments presently disclosed, the charging handle 35 is coupled with the charging base 40 using, for example, a fastener 165 shown in FIG. 4. The fastener 165 may be a pin, a spring pin, a screw, a set screw, a full dog point set screw, or a dogleg set screw. According to some embodiments presently disclosed, the charging base 40 comprises an opening 170 and the first sidewall 182 comprises an opening 175. The openings 170 and 175 are configured to accommodate the fastener 165. According to some embodiments presently disclosed, the second sidewall 184 also comprises an opening (not shown) configured to accommodate the fastener 165.

Figure 7:
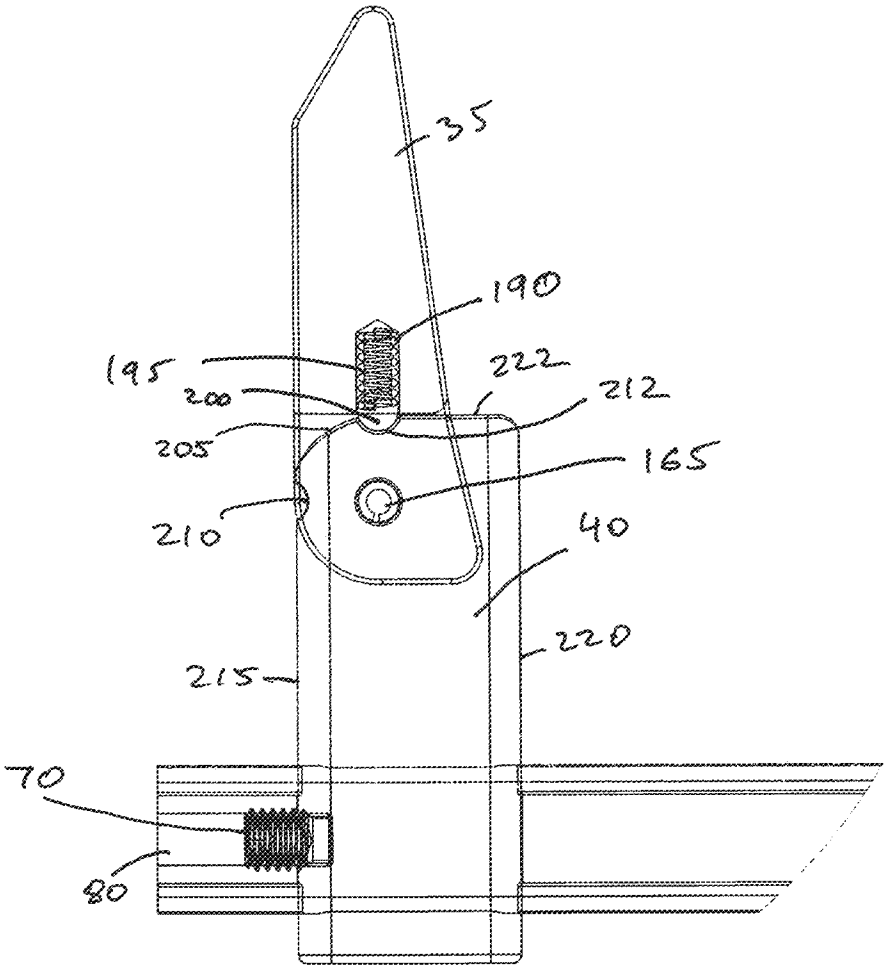

According to some embodiments presently disclosed, the charging handle 35 is configured to pivot about the fastener 165. According to some embodiments presently disclosed, the charging handle 35 is configured to pivot about the fastener 165 from a first (folded) position to a second (extended) position and back to the first (folded) position. According to some embodiments presently disclosed, the first (folded) position is position in which the charging handle 35 is substantially parallel to the barrel 15 (shown in FIGS. 2*a-b*, 3 and 5). According to some embodiments presently disclosed, the second (extended) position is any position other than the first (folded) position as shown in FIG. 7. According to some embodiments presently disclosed, the second (extended) position is position in which the charging handle 35 is substantially perpendicular to the charging base 40 as shown in FIG. 7.

According to some embodiments presently disclosed, the charging base 40 comprises a forward edge 215, a rear edge 220, a side edge 222, a semi circular edge 205 between the forward edge 215 and the side edge 222, and a first cavity 210 disposed on the forward edge 215. According to some embodiments presently disclosed, the charging base 40 may comprise a second cavity 212 disposed on the side edge 222.

Figure 6:
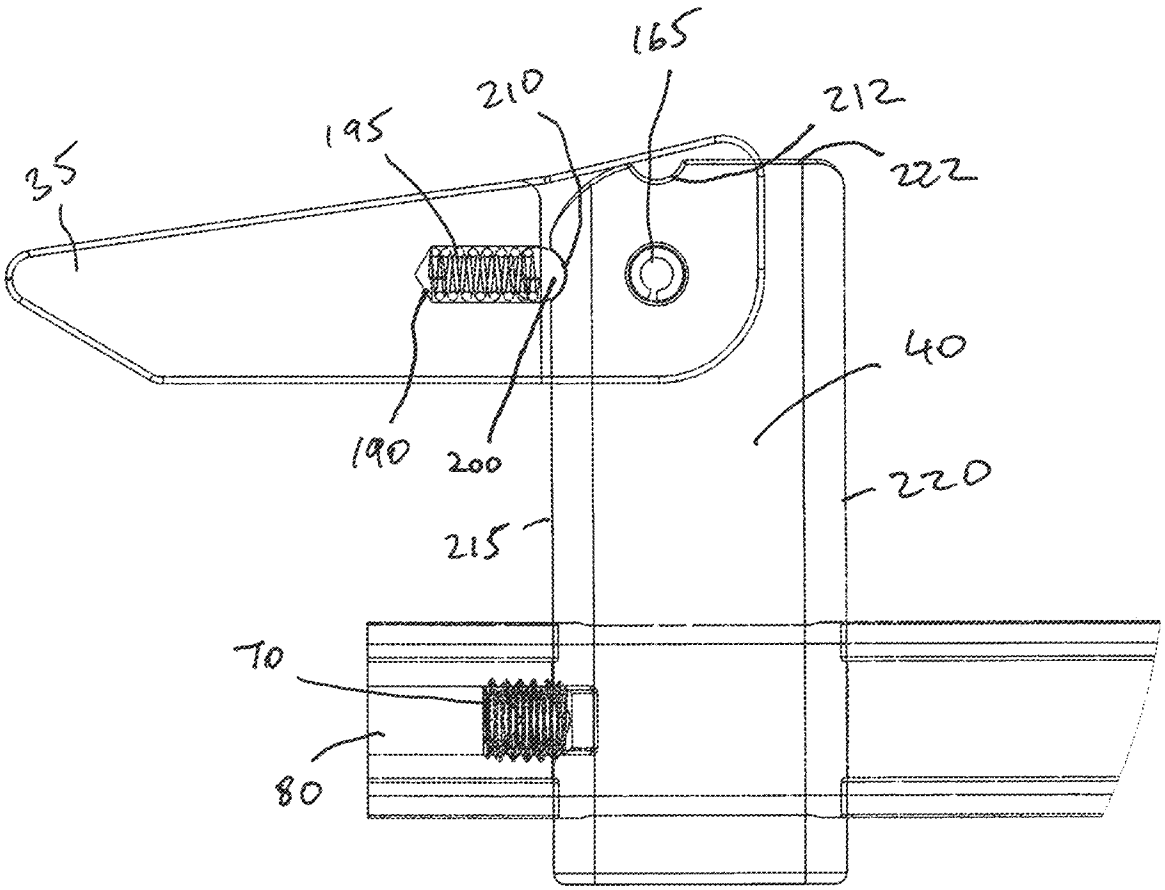

According to some embodiments presently disclosed, the top wall 186 of the U-shaped channel 180 comprises an opening 190 configured to accommodate a spring 195 and a ball bearing 200 as shown in FIGS. 4, 6-7. According to some embodiments presently disclosed, the spring 195 is disposed in the opening 190 and the ball bearing 200 is disposed between the spring 195 and the charging base 40. When the charging handle 35 is in the first (folded) position, the ball bearing 200 is positioned in the first cavity 210 to prevent the charging handle 35 from moving to the second (extended) position. According to some embodiments presently disclosed, after applying a third force to the charging handle 35, the ball bearing 200 is pushed out of the first cavity 210 and rolls along the semi-circular edge 205 until the top wall 186 abuts the side edge 222 and/or until the charging handle 35 reaches the second (extended) position. According to some embodiments presently disclosed, after applying a third force to the charging handle 35, the ball bearing 200 is pushed out of the cavity 210 and rolls along the semi-circular edge 205 until it is positioned in the second cavity 212. According to some embodiments presently disclosed, when the charging handle 35 is in the second (extended) position, the ball bearing 200 is positioned in the second cavity 212 to prevent the charging handle 35 from moving to the first (folded) position. According to some embodiments presently disclosed, a force of the spring 50 returning the charging trolley 45 back to the first (rest) position causes the charging handle 35 to move from the second (extended) position to the first (folded) position. According to some embodiments presently disclosed, a force of the spring 50 returning the charging trolley 45 back to the first (rest) position causes the charging handle 35 to move from the second (extended) position to the first (folded) position and position the ball bearing 200 in the cavity 210. According to some embodiments presently disclosed, a force of the spring 50 returning the charging trolley 45 back to the first (rest) position causes the ball bearing 200 to be pushed out of the cavity 212 and roll in to the cavity 210.

Figure 14:
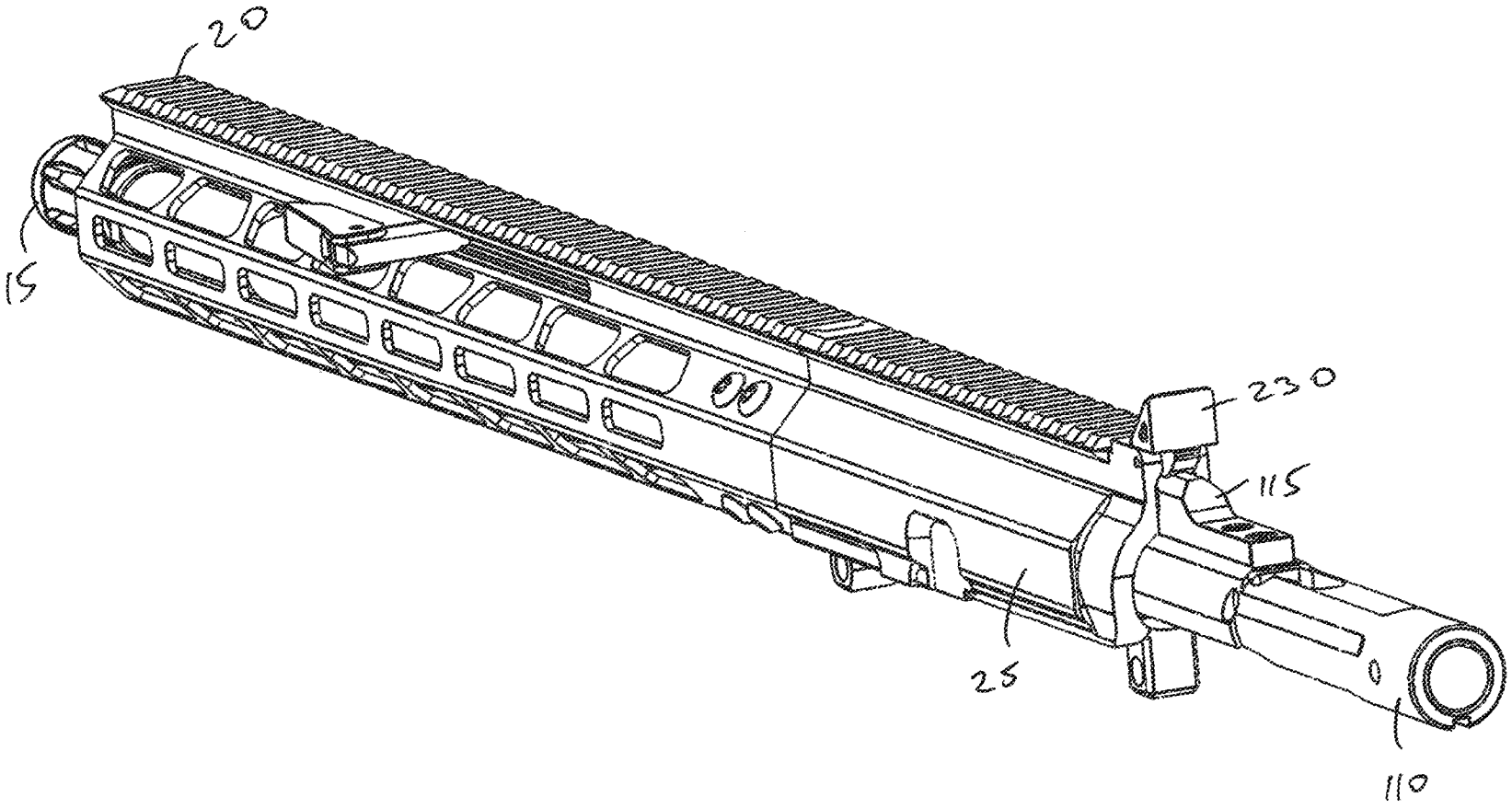
FIGS. 14-15 depict a trap door according to the present disclosure.
Figure 15:
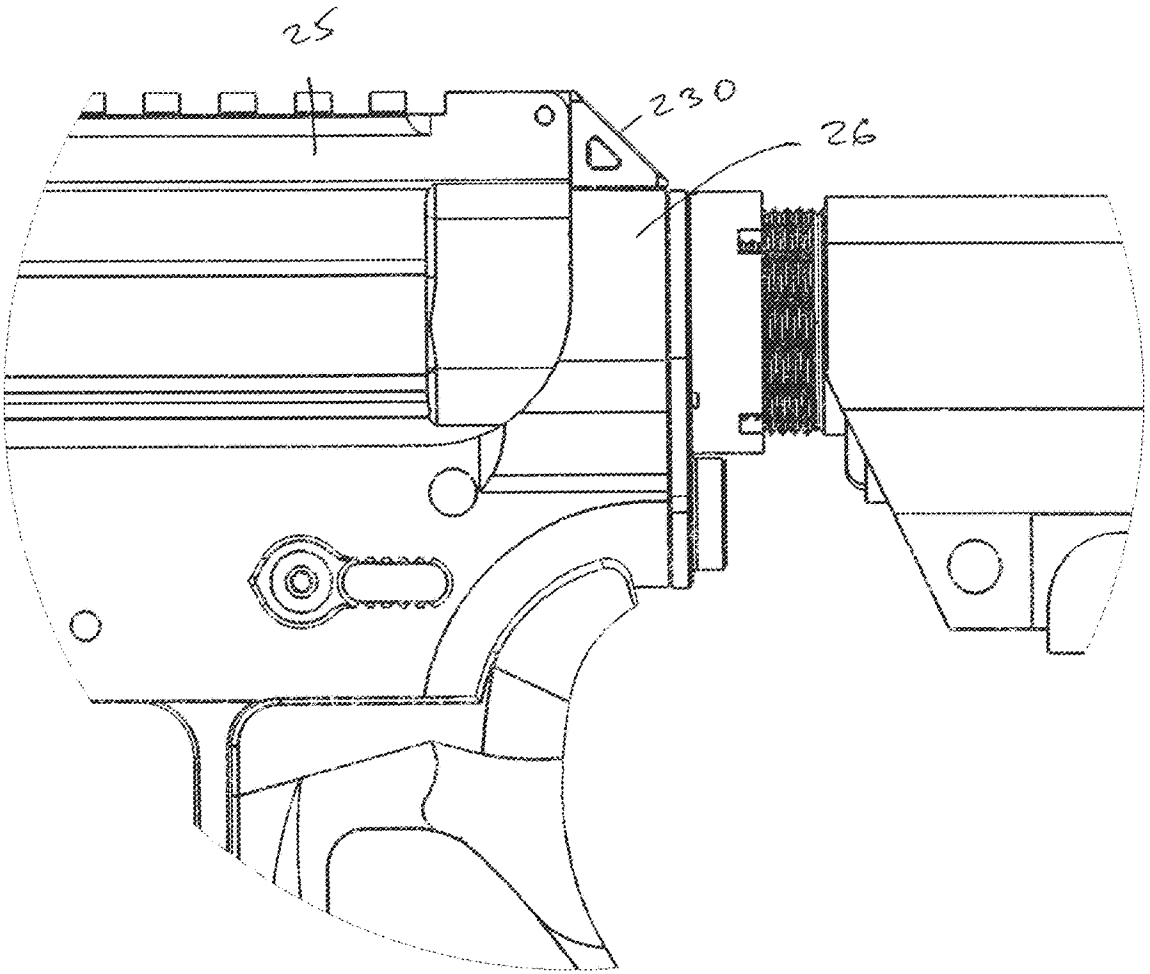

According to some embodiments presently disclosed, the upper receiver 25 comprises a trap door 230 (shown in FIGS. 14-15). The trap door 230 may be pivotally coupled with the upper receiver 25. The rap door 230 is pivotally movable from the first (open) position (shown in FIG. 14) to the second (closed) position (shown in FIG. 15) and back to the first (open) position. The trap door 230 may be moved to the first (open) position when the upper receiver 25 is at least partially removed (i.e. pivoted away) from the lower receiver 26. The carrier key 115 coupled with the bolt carrier assembly 110 may be removed from the upper receiver 25 when the trap door 230 is in the first (open) position as shown in FIG. 14. The trap door 230 is securely locked in the second (closed) position when the upper receiver 25 is coupled with the lower receiver 26 as shown in FIG. 15. The lower receiver 26 prevents the trap door 230 from moving towards the first (open) position when the upper receiver 25 is coupled with the lower receiver 26 as shown in FIG. 15.

It is to be understood that the forward charging system 30 described above may be implemented on different types of firearms. The forward charging system 30 described above may be implemented on firearms using a blowback system of operation, and/or firearm using a direct impingement system of operation, and/or firearm using piston system of operation. Blowback is a system of operation for self-loading firearms that obtains energy from the motion of the cartridge case as it is pushed to the rear by expanding gas crated by the ignition of the propellant charge. Direct impingement is a type of gas operation for a firearm that directs gas from a fired cartridge directly into the bolt carrier to cycle the action. Piston system uses gas pressure to mechanically move the bolt carrier to cycle the action. It is also to be understood that the forward charging system 30 described above may be implemented on M-16 and Armalite style rifles (ARs).

Figure 16:
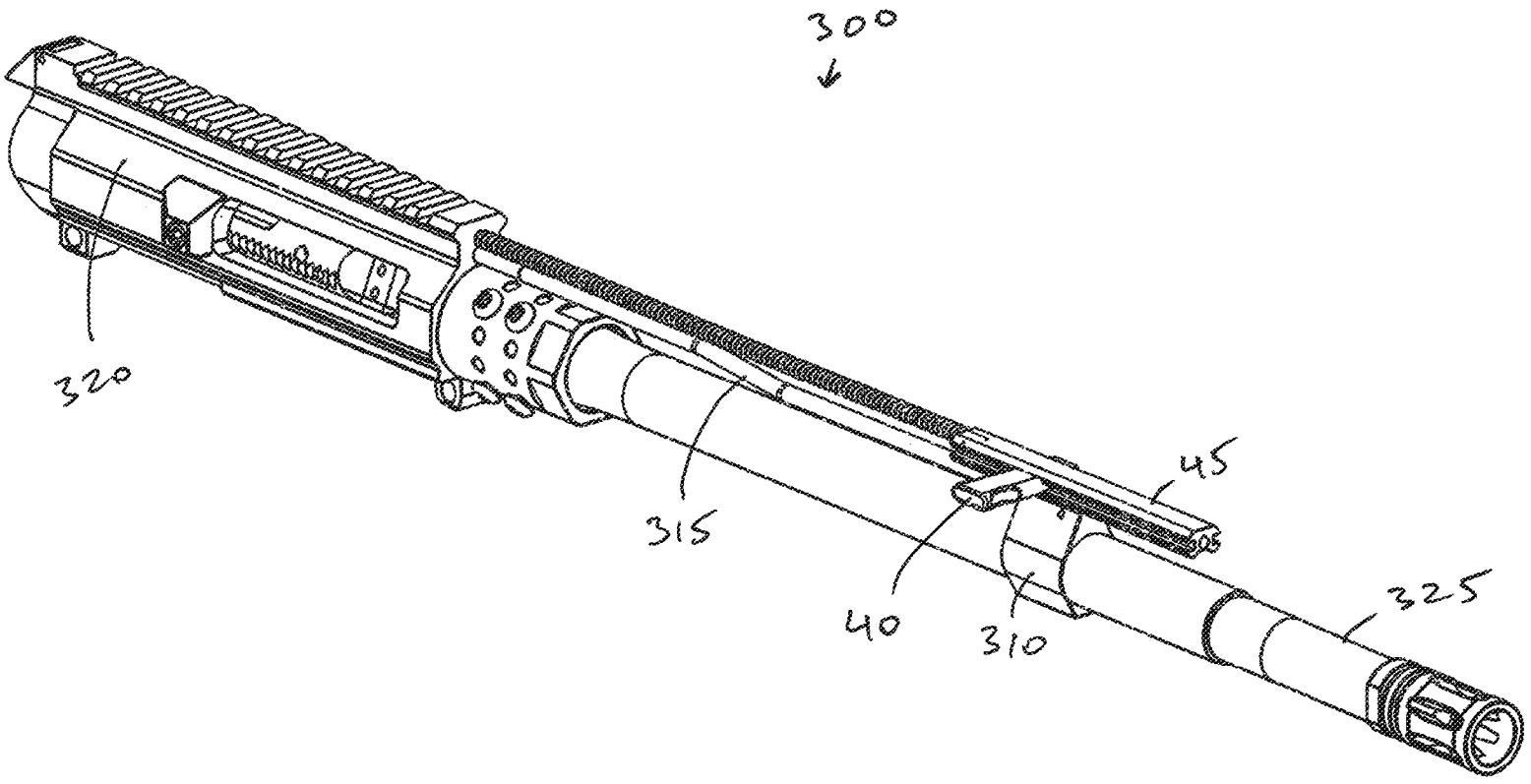
FIGS. 16-20 depict forward charging system according to the present disclosure on a firearm using direct impingement system.
Figure 17:
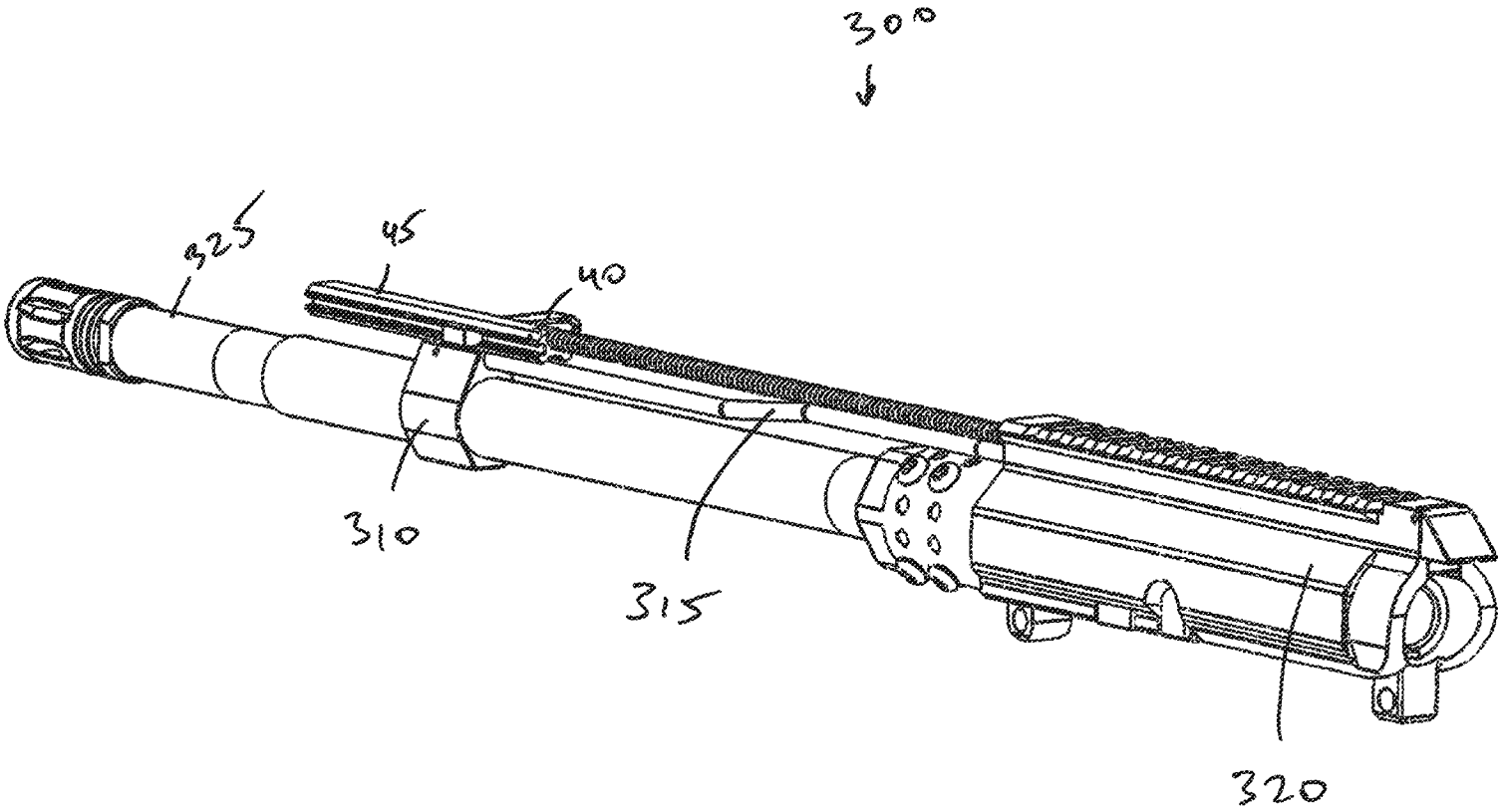

Referring to FIGS. 16-20, the forward charging system 30 is shown on an upper receiver assembly 300 using for example, a direct impingement system. Referring to FIGS. 16-17, the upper receiver assembly 300 is shown according to some embodiments presently disclosed. The upper receiver assembly 300 comprises a barrel 325, gas block 310 coupled with the barrel, gas tube 315, and an upper receiver 320. The upper receiver assembly 300 may comprise a hand guard 20 as shown in FIG. 11 and described above. According to some embodiments presently disclosed, the upper receiver assembly 300 comprises the forward charging system 30 as described above.

Figure 18:
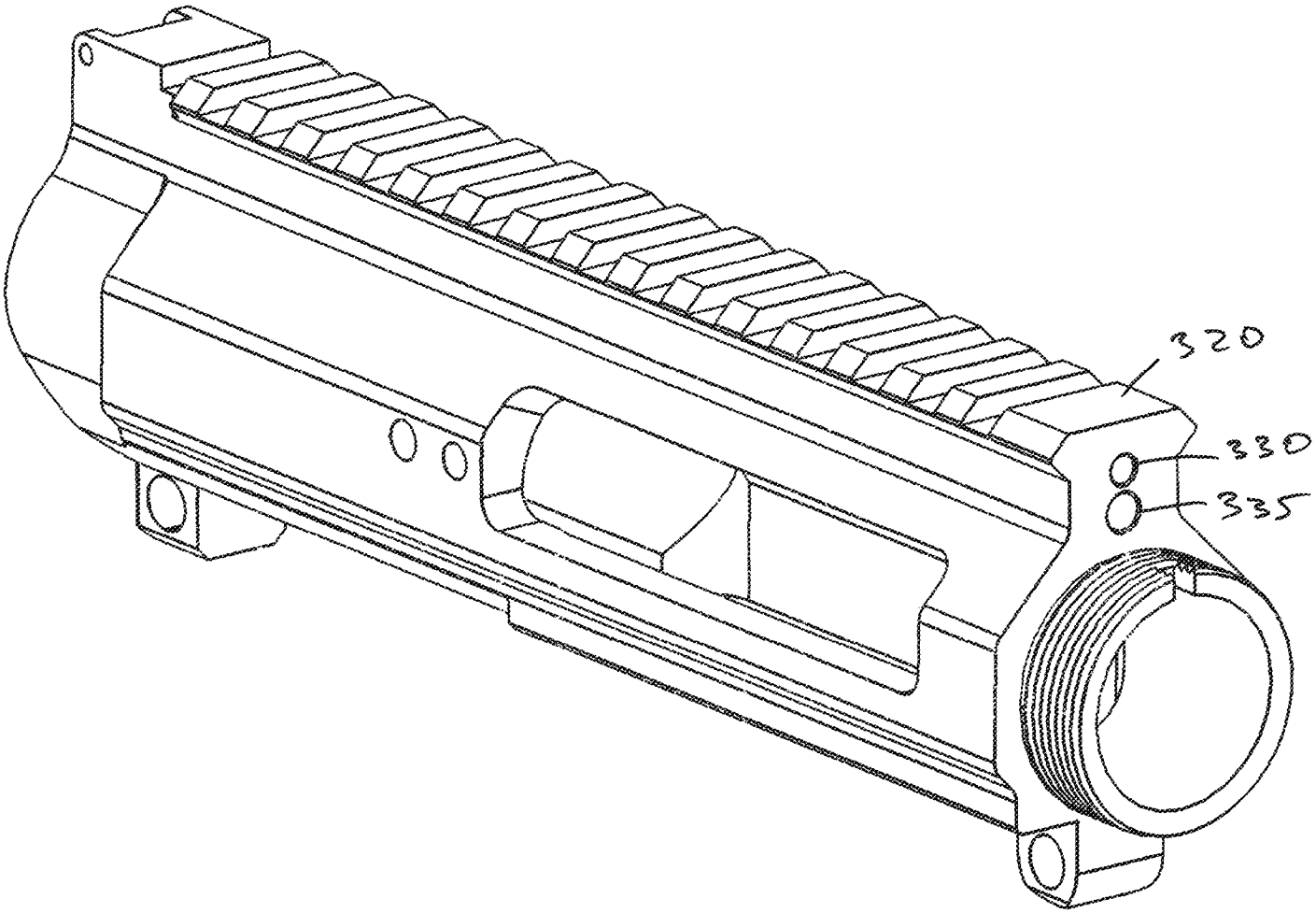
Figure 19:
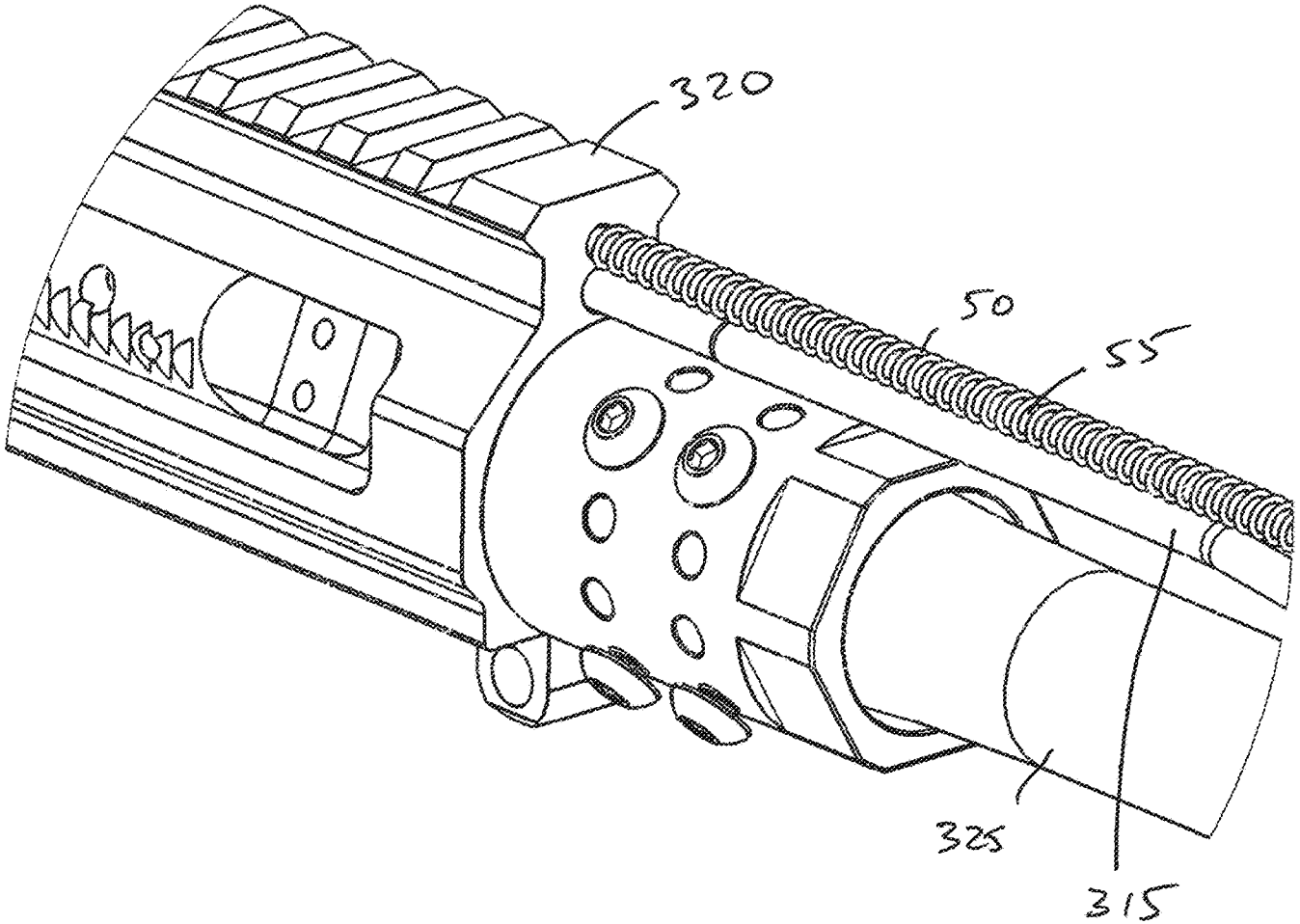
Figure 20:
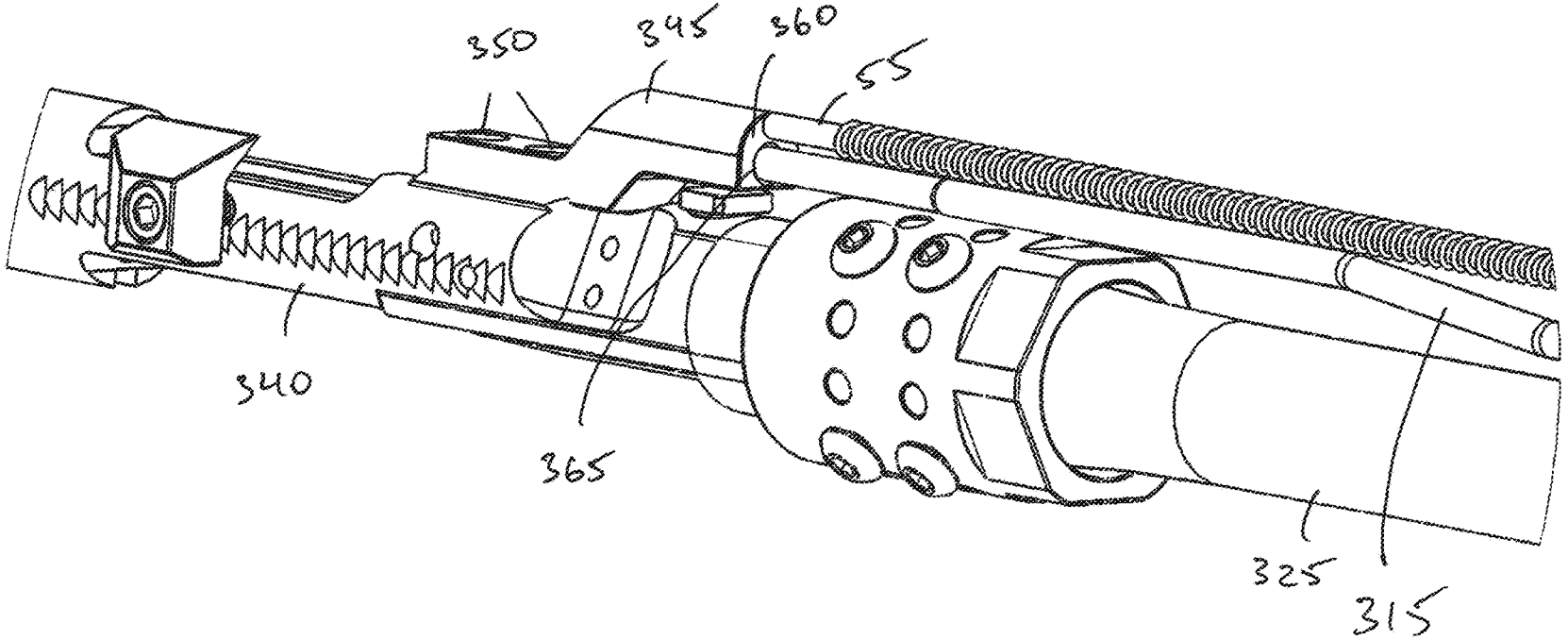

Referring to FIGS. 16-17, the charging trolley 45 may be positioned above the gas block 310. The rod 55 may be positioned above the gas tube 315. Referring to FIGS. 18-19, the upper receiver 320 comprises an opening 330 (shown in FIG. 18) to accommodate the rod 55 (shown in FIG. 19) and an opening 335 (shown in FIG. 18) to accommodate the gas tube 315 (shown in FIG. 19).

According to some embodiments presently disclosed, the upper receiver 320 comprises a bolt carrier assembly 340. The bolt carrier assembly 340 is movable between a first (i.e. locked) position and a second (i.e. unlocked) position. The bolt carrier assembly 340 supports and positions a bolt (not shown). The first (locked) position is position in which the bolt carrier 340 has positioned the bolt (not shown) for firing ammunition through the barrel 325. The second (unlocked) position is any position other than the first (locked) position.

According to some embodiments presently disclosed, the upper receiver 320 comprises a carrier key 345 coupled with a top portion of the bolt carrier assembly 340. One or more fasteners 350 may be used to couple the carrier key 345 with the bolt carrier assembly 340. The one or more fasteners 350 may be a pin, a screw, a set screw, a full dog point set screw, or a dogleg set screw. The carrier key 345 comprises a surface 360 configured to abut the rod 55 when the bolt carrier 340 is being moved from away from the first (locked) position. The surface 360 comprises an opening 365 configured to accommodate the gas tube 315.

According to some embodiments presently disclosed, the forward charging system 30 as described in detail above is configured to move the bolt carrier assembly 340 from the first (locked) position to the second (unlocked) position.

According to some embodiments presently disclosed, the hand guard 20 (shown in FIG. 11) may comprise opening 116 on either right side of the firearm or left side of the firearm or on both sides of the firearm. This allows the operator of the firearm to position the charging base 40 on either side of the firearm depending if the operator is right handed or left handed.

According to some embodiments presently disclosed, the hand guard 20 (shown in FIG. 11) may comprise multiple openings 116 along the hand guard 20. Having multiple opening 116 available along the hand guard 20 allow the operator to select how far the charging base 40 is from the upper receiver 25. If the operator of the firearm has long arms, the charging base 40 may be placed through an opening 116 located farther away from the upper receiver 25. If the operator of the firearm has short arms, the charging base 40 may be placed through an opening 116 located closer to the upper receiver 25. According to some embodiments presently disclosed, the forward charging system 30 may be provided with different length rods 55 to accommodate operators with different arm lengths. According to some embodiments presently disclosed, the forward charging system 30 may be provided with the rod 55 having adjustable length to accommodate operators with different arm lengths. According to some embodiments presently disclosed, the forward charging system 30 may be provided with the rod 55 that can be shortened to accommodate operators with shorter arm.

While several illustrative embodiments of the invention have been shown and described, numerous variations and alternative embodiments will occur to those skilled in the art. Such variations and alternative embodiments are contemplated, and can be made without departing from the scope of the invention as defined in the appended claims.

As used in this specification and the appended claims, the singular forms "a," "an," and "the" include plural referents unless the content clearly dictates otherwise. The term "plurality" includes two or more referents unless the content clearly dictates otherwise. Unless defined otherwise, all technical and scientific terms used herein have the same meaning as commonly understood by one of ordinary skill in the art to which the disclosure pertains.

What is claimed is:

1. An upper receiver assembly of a firearm, the upper receiver assembly comprising:

an upper receiver comprising a bolt carrier assembly, wherein the bolt carrier assembly is movable between a locked position and an unlocked position;

a barrel coupled with the upper receiver;

a hand guard comprising a first opening configured to accommodate the barrel, the hand guard comprising one or more rails protruding into the opening;

a charging trolley comprising one or more channels configured to accommodate the one or more rails, wherein the charging trolley is movable along the one or more rails between a rest position and a charging position; and a rod coupled to a rear portion of the charging trolley, the rod is configured to move the bolt carrier assembly away from the locked position when the charging trolley is moved away from the rest position.

2. The upper receiver assembly of claim 1, wherein the hand guard is coupled with the upper receiver.

3. The upper receiver assembly of claim 1, wherein the hand guard is coupled with the barrel.

4. The upper receiver assembly of claim 1, further comprising a return spring positioned between the upper receiver and the charging trolley, wherein the rod is positioned within the return spring.

5. The upper receiver assembly of claim 1, wherein the upper receiver comprises a through opening configured to accommodate the rod and to allow the rod to move the bolt carrier assembly away from the locked position.

6. The upper receiver assembly of claim 1, further comprising a charging base coupled to a front portion of the charging trolley and extending through a second opening in the hand guard.

7. The upper receiver assembly of claim 6, further comprising a charging handle rotationally coupled with the charging base, wherein the charging handle is movable between a folded position and an extended position.

8. The upper receiver assembly of claim 1, wherein the rod is positioned between the charging trolley and the bolt carrier assembly.

9. The upper receiver assembly of claim 1, wherein the charging trolley is positioned adjacent to a front of the firearm.

10. The upper receiver assembly of claim 1, wherein the barrel comprises a first end and a second end, wherein the second end of the barrel is coupled with the upper receiver, wherein the charging trolley is positioned adjacent to the first end of the barrel.

* * * * *